US008213846B2

(12) United States Patent
Saito

(10) Patent No.: US 8,213,846 B2
(45) Date of Patent: Jul. 3, 2012

(54) IMAGE FORMING APPARATUS WITH BELT ADJUSTMENT

(75) Inventor: Makoto Saito, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 351 days.

(21) Appl. No.: 12/578,954

(22) Filed: Oct. 14, 2009

(65) Prior Publication Data

US 2010/0098465 A1 Apr. 22, 2010

(30) Foreign Application Priority Data

Oct. 20, 2008 (JP) ..... 2008-270346

(51) Int. Cl.
*G03G 15/01* (2006.01)

(52) U.S. Cl. ..... 399/302

(58) Field of Classification Search ..... 399/119, 399/120, 302, 308, 312
See application file for complete search history.

(56) References Cited

U.S. PATENT DOCUMENTS

| | | | | |
|---|---|---|---|---|
| 6,904,245 | B2 | 6/2005 | Mochizuki et al. | |
| 6,990,300 | B2 * | 1/2006 | Saito et al. | 399/101 |
| 2006/0054467 | A1 | 3/2006 | Oishi | |
| 2008/0310891 | A1 | 12/2008 | Mochizuki | |

FOREIGN PATENT DOCUMENTS

| | | | | |
|---|---|---|---|---|
| JP | 7-334011 | A | | 12/1995 |
| JP | 11-219046 | A | | 8/1999 |
| JP | 2000-34031 | A | | 2/2000 |
| JP | 2001-249519 | A | | 9/2001 |
| JP | 2001-341883 | A | | 12/2001 |
| JP | 3649270 | B2 | | 5/2005 |
| JP | 2006-78612 | A | | 3/2006 |
| JP | 2008-309941 | A | | 12/2008 |
| JP | 2009-42723 | A | | 2/2009 |
| JP | 2009093086 | A | * | 4/2009 |

* cited by examiner

*Primary Examiner* — Quana M Grainger

(74) *Attorney, Agent, or Firm* — Fitzpatrick, Cella, Harper & Scinto

(57) ABSTRACT

In the image forming apparatus of this invention, a bending habit is applied to a PET sheet by a heating iron to form an end mylar into an L shape. In a full-color mode, the end mylar presses an end of an intermediate transfer belt while being elastically deformed. In a black monochrome mode, the intermediate transfer belt is spaced from photosensitive drums by up to 2 mm compared with the full-color mode. Instead of the photosensitive drums spaced from the intermediate transfer belt, the end mylar regulates the end of the intermediate transfer belt in a vertical direction by a slightly small pressing force with a recovered bend, whereby flapping of the intermediate transfer belt is reduced.

12 Claims, 9 Drawing Sheets

FULL-COLOR MODE

BLACK MONOCHROME MODE

FULL-COLOR MODE

BLACK MONOCHROME MODE

FULL-COLOR MODE

BLACK MONOCHROME MODE

IMAGE FORMING APPARATUS WITH BELT ADJUSTMENT

BACKGROUND OF THE INVENTION

1. Field of the Invention

This invention relates to an image forming apparatus including a belt member, which can be brought into and out of contact with a rotating body and is steering controlled.

2. Description of the Related Art

There has been put into practical use an image forming apparatus including a belt member (intermediate transfer belt, recording material conveying belt, or a transfer belt), which can be brought into and out of contact with a rotating body and is steering controlled.

Japanese Patent Application Laid-Open (JP-A) No 2001-249519 discloses a tandem full-color printer in which a belt member is in press-contact with a plurality of image bearing members having different developing colors to form a full-color image. In this full-color printer, some image bearing members and the belt member are spaced from each other by movement of a portion of the belt member (a stretched surface of the belt member). Namely, in a full-color mode where four toner images are superposed, the belt member is abutted against the plurality of image bearing members to transfer the toner images of the respective colors; meanwhile, in a monochrome mode of forming a monochrome image, the belt member is spaced from an unused image bearing member. In this constitution, since only the belt member is moved, the constitution is easier and more preferable, compared with the conventional constitution in which the plurality of image bearing members are each spaced from the belt member.

JP-A No. 2000-34031 discloses an image forming apparatus which controls the inclination of one of a plurality of support rotating bodies around which a belt member is wound and moves the belt member in the rotational axis direction of the belt member, whereby the wrinkling of the belt member is controlled. In this image forming apparatus, a deviation of the rotational position of the belt member is modified by performing such steering control that the belt member is moved in the longitudinal direction of the support rotating body in response to the output of a sensor for detecting a position in the rotational axis direction of the belt member.

In such steering control, for the purpose of detecting the position of an end of the belt member to adjust the position of the belt member, the stability of the shape of the end of the belt member is required. JP-A Nos. 7-334011, 11-219046, 2001-341883, and 2006-78612 propose various constitutions for preventing deformation of the end of the belt member. Specifically, there proposed a reinforced structure (JP-A No. 7-334011) and a rib (JP-A No. 11-219046) which prevent movement to the inside surface of the end of the belt member. JP-A No. 2001-341883 proposes a constitution for regulating a belt surface for the purpose of preventing a belt from being caught when detached and attached, on the ground of warpage of the belt of a roller portion, which serves as a fulcrum when the belt is swung. JP-A No. 2006-78612 proposes that the end of the belt member is nipped by using a pair of rollers. In addition to the above publications, JP-A Nos. 2009-42723 and 2008-309941 propose a constitution for preventing deformation of a belt.

As in JP-A No. 2000-34031, when the steering control is performed, the warpage of the end of the belt member is suppressed to thereby enhance the stability of the shape of the end of the belt member, whereby the stability of the control of the wrinkling of the belt member can be enhanced. Therefore, it is preferable that a fixed end regulating member is disposed on the upstream side of a detection device, which detects the position of the end of the belt member in the rotational direction of the belt member, whereby the warpage of the end of the belt member is regulated.

However, as in JP-A No. 2001-249519, when the belt member can be spaced from some image bearing members, the stretched surface of the belt member varies accompanying the contact/separation operation. Namely, in the full-color mode, for the purpose of preventing color deviation, it is preferable that the end of the belt member is regulated by the fixed end regulating member. Meanwhile, in the monochrome mode, the color deviation does not occur, and thus, if the end of the belt member is not regulated in the monochrome mode, the following problem occurs.

In the full-color mode, the wrinkling of the belt member is controlled in such a state that the warpage of the end of the belt member is small. Meanwhile, in the monochrome mode, the wrinkling of the belt member is controlled in such a state that the end of the belt member warps. Namely, in the monochrome mode, the position of the belt member is adjusted to the position of the state in which the end of the belt member warps. According to this constitution, when the mode is shifted from the monochrome mode to the full-color mode, the warpage of the end of the belt member is reduced, and therefore, the variation of the position of the end of the belt member detected by the detection device is increased. Consequently, the frequency of the wrinkling control for reducing the positional variation increases in the full-color mode, whereby the color deviation easily occurs.

SUMMARY OF THE INVENTION

The present invention provides an image forming apparatus which can realize the reduction of a variation amount of wrinkling adjustment in the shift from a BK monochrome mode to a color mode, even if an end of a belt member warps.

In order to achieve the above problem, the image forming apparatus of the present invention has the following constituents: a first image bearing member; a second image bearing member, a rotatable belt member which can be in contact with the first and second image bearing members; a detection member which detects a position of an end of the belt member; a steering mechanism which adjusts a position of the belt member in a rotational axis direction of the belt member, based on an output of the detection member; a contact/separation mechanism which moves a belt surface of the belt member and is configured to allow the belt member to bring into and out of contact with the first image bearing member; an execution portion which executes a first image formation mode, where the belt member is in contact with the first image bearing member and the second image bearing member and an image is formed on the belt member by the first and second image bearing members, and a second image formation mode, where the belt member is spaced from the first image bearing member, and, at the same time, is in contact with the second image bearing member and an image is formed on the belt member by the second image bearing member; and a pressing member which presses the end of the belt member on the upstream side of the detection member in a rotational direction of the belt member in the first and second image formation modes.

Further features of the present invention will become apparent from the following description of exemplary embodiments with reference to the attached drawings.

DESCRIPTION OF THE EMBODIMENTS

Hereinafter, an embodiment of the present invention will be described in detail with reference to the drawings. The present invention can be practiced in other embodiments, in which some or all components of the present embodiment are replaced by the alternative components, as long as an end of a belt member is kept pressed even if the belt member is spaced from an image bearing member.

Thus, the present invention can be applied to not only an image forming apparatus using an intermediate transfer belt, but also an image forming apparatus which transfers a toner image to a recording material borne by a recording material conveying belt.

In the present embodiment, although only major parts associated with formation and transfer of a toner image are described, the present invention can be applied to various uses, such as a printer, various printing machines, a copying machine, a FAX, and a complex machine, by adding necessary devices, equipments and a casing structure.

<Image Forming Apparatus>

Figure 1:
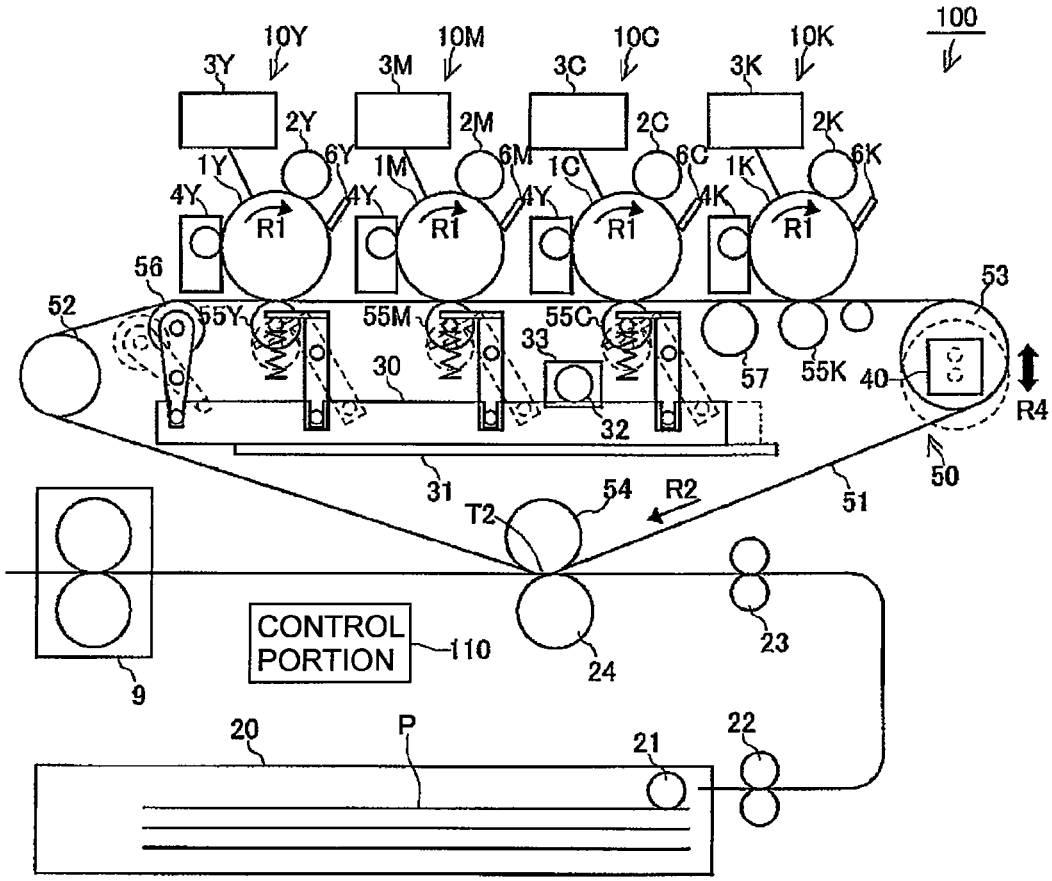
FIG. 1 is an explanatory view of a configuration of an image forming apparatus of a first embodiment.

FIG. 1 is an explanatory view of a configuration of an image forming apparatus of a first embodiment.

As shown in FIG. 1, an image forming apparatus 100 is a tandem full color printer which includes image forming portions 10Y, 10M, 10C, and 10K having different developing colors and disposed in a linear section of an intermediate transfer belt 51. The image forming apparatus 100 incorporates therein various unitized devices required for an image forming process for forming a toner image on a photosensitive drum serving as an image bearing member, and an intermediate transfer unit 50 is provided as one of the unitized devices.

In the image forming portion 10Y, a yellow toner image is formed on a photosensitive drum 1Y to be primary-transferred onto the intermediate transfer belt 51. In the image forming portion 10M, a magenta toner image is formed on a photosensitive drum 1M, and is primary-transferred onto the intermediate transfer belt 51 so as to be superposed on the yellow toner image on the intermediate transfer belt 51. In the image forming portions 10C and 10K, a cyan toner image and a black toner image are respectively formed on photosensitive drums 1C and 1K, and these toner images are sequentially primary-transferred onto the intermediate transfer belt 51 so as to be superposed on the toner image on the intermediate transfer belt 51.

The four color toner images borne by the intermediate transfer belt 51, which is a belt member, are conveyed to a secondary transfer portion T2 to be collectively secondary-transferred onto a recording material P, which is nipped and conveyed through the secondary transfer portion T2 while superposed onto the intermediate transfer belt 51. The recording material P onto which the toner images are secondary-transferred in the secondary transfer portion T2 undergoes heating and pressure in a fixing unit 9. The toner images are fixed onto the surface of the recording material P, and thereafter, the recording material P is discharged outside.

The recording material P drawn from a cassette 20 by a pickup roller 21 is separated into one sheet by a separation roller 22 to be fed to a registration roller 23. The recording material P stays at the registration roller 23, and is advanced to the secondary transfer portion T2 in synchronization with the toner image on the intermediate transfer belt 51.

The image forming portions 10Y, 10M, 10C, and 10K have substantially the same constitution except that the colors of the toners used in development devices 4Y, 4M, 4C, and 4K attached thereto are different from each other (yellow, magenta, cyan, and black). Hereinafter, the image forming portion 10Y will be described, and the other image forming portions 10M, 10C, and 10K will be described by replacing Y, added to the ends of the reference numerals in the description, by M, C, and K.

The image forming portion 10Y includes a charging device 2Y, an exposure device 3Y, the development device 4Y, a primary transfer roller 55Y, and a cleaning device 6Y disposed around the photosensitive drum 1Y.

The photosensitive drum 1Y is made of a metal cylinder with a photosensitive layer having a negative charge polarity and formed on the surface and rotates in a direction of an arrow R1 at a predetermined process speed.

In the charging device 2Y, a charging roller is in press-contact with the photosensitive drum 1Y to rotate the photosensitive drum 1Y. A vibrating voltage obtained by superposing an AC voltage on a DC voltage is applied to the charging roller, and the surface of the photosensitive drum 1Y is charged to a uniform potential of negative polarity.

The exposure device 3Y scans scanning line image data, obtained by expanding the image data, with an on-off modulated laser beam by means of a polygon mirror and writes an electrostatic image on the surface of the charged photosensitive drum 1Y.

The development device 4Y includes a developing sleeve bearing a toner charged to a negative polarity and slides and rubs against the photosensitive drum 1Y. The vibrating voltage obtained by superposing the AC voltage on the negative DC voltage is applied to the developing sleeve, and the electrostatic image on the photosensitive drum 1Y is inversely developed.

The primary transfer roller 55Y which is a primary transfer member is in press-contact with the photosensitive drum 1Y through the intermediate transfer belt 51 to nip the intermediate transfer belt 51. An AC voltage having a positive polarity is applied to the primary transfer roller 55Y, whereby the toner image charged to a negative polarity and borne by the photosensitive drum 1Y is primary-transferred onto the intermediate transfer belt 51.

The secondary transfer roller 24 which is a secondary transfer member is in press-contact with a counter roller 54 through the intermediate transfer belt 51 to form the secondary transfer portion T2 between the intermediate transfer belt 51 and the secondary transfer roller 24. The secondary transfer portion T2 nips and conveys the recording material P so that the recording material P is superposed on the toner image on the intermediate transfer belt 51. A positive polarity voltage is applied to the secondary transfer roller 24, whereby the toner image charged to a negative polarity and borne by the intermediate transfer belt 51 is secondary-transferred onto the recording material P.

For the primary transfer roller 55Y, a primary transfer roller, which has a resistance value of $1\times10^2$ to $10^8\Omega$ when subjected to a voltage of 2000V, can be used. In this embodiment, as the primary transfer roller 55Y, an ion-conductive sponge roller, which is formed by blending nitrile rubber and an ethylene-epichlorohydrin copolymer and has an outer diameter of 16 mm and a core bar diameter of 8 mm, is used. The primary transfer roller 55Y, which has a resistance value of $1\times10^6$ to $10^8\Omega$ when measured at the applied voltage of 2 kV under the measurement environment at temperature of 23° C. and humidity of 50%, is used.

For the counter roller 54, a semiconductive roller, which contains a conductive carbon dispersed in an EPDM rubber and has an outer diameter of 20 mm and a core bar diameter of 16 mm, is used. The counter roller 54, which has a resistance value of $1\times10^1$ to $10^5\Omega$ when measured at the applied voltage of 10 V under the same measurement environment as in the above case, is used.

For the secondary transfer roller 24, an ion-conductive sponge roller, which is formed by blending nitrile rubber and an ethylene-epichlorohydrin copolymer and has an outer diameter of 24 mm and a core bar diameter of 12 mm, is used. The secondary transfer roller 24, which has a resistance value of $1\times10^6$ to $10^8\Omega$ when measured at the applied voltage of 2 kV under the same measurement environment as in the above case, is used.

<Intermediate Transfer Unit>

Figure 2:
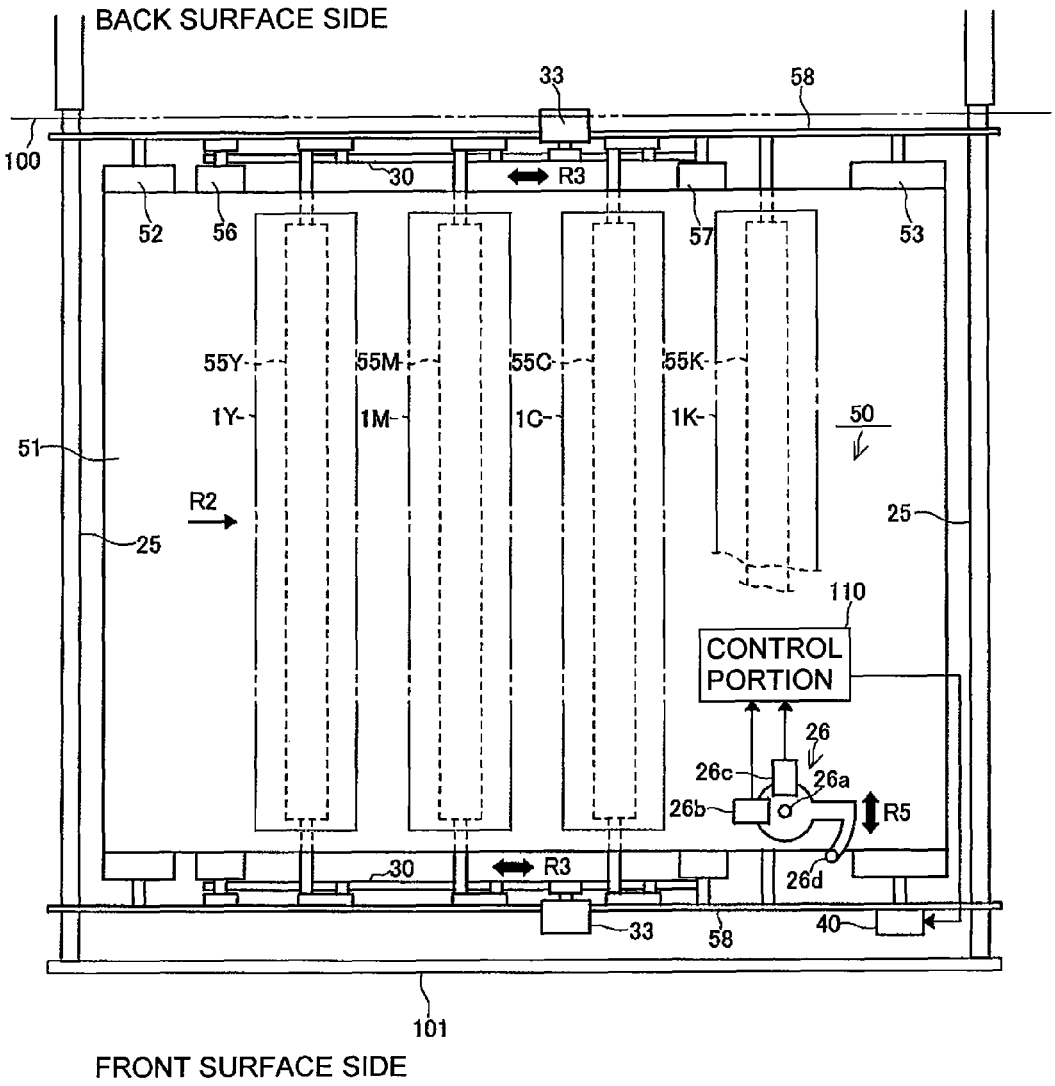
FIG. 2 is an explanatory view of a drawn state of an intermediate transfer unit.

FIG. 2 is an explanatory view of a drawn state of an intermediate transfer unit.

As shown in FIG. 1, the intermediate transfer unit 50 is constituted by integrally assembling a belt member 51, a steering mechanism 40, and a contact/separation mechanism 30. The intermediate transfer unit 50 is mounted in the image forming apparatus 100 in a detachably attachable manner. The belt member 51 is supported so as to be hooked over a plurality of stretching members 52, 53, and 54. In this example, the stretching members are rollers. The steering mechanism 40 controls the inclination of a steering roller 53, which is the stretching member, to move the belt member 51 in the longitudinal direction of the stretching members 52, 53, and 54. The contact/separation mechanism 30 allows the belt member 51 to be spaced from a plurality of photosensitive drums 1M, 1C, and 1K while the remaining photosensitive drum 1K is kept in contact with the belt member 51.

The intermediate transfer belt 51 is supported so as to be hooked over a tension roller 52, a driving roller 53, and the counter roller 54 and is driven by the driving roller 53 to rotate at a process speed of 200 mm/sec in a direction of an arrow R2. Moreover, the driving roller 53 has the function as steering roller concurrently.

An intermediate transfer member is formed of a material, which is rendered semiconductive by mixing a conductive powder serving as a resistance adjuster, such as carbon black, into a resin material with a high mechanical strength such as polyimide (PI) and polyethylene terephthalate (PET).

In this embodiment, the intermediate transfer belt 51 is formed in an endless loop with a circumferential length of 900 mm by using as a base material a polyimide resin film with a thickness of 100 μm. A carbon black is dispersed in a polyimide base material, whereby the polyimide base material is subjected to resistance adjustment so that a non-dielectric constant $\in=3$ to 5 and a volume resistivity $\rho=1\times10^6$ to $10^{11}$ Ω/m.

As shown in FIG. 2, in the image forming apparatus 100, slide guides 25 are drawn to the front side, and the intermediate transfer unit 50 is located outside a casing. Thereafter, the intermediate transfer unit 50 is collectively taken out upward to thereby be allowed to be detached and attached. The intermediate transfer unit 50 is held, in a detachably attachable manner, within a frame with a front side plate 101 fastened on the front side of moving-side members of the slide guides 25. In the intermediate transfer unit 50, an engaging member (not shown) provided in the intermediate transfer unit 50 lands on the upper surface of the slide guide 25.

As shown in FIG. 1, a manual lever (not shown) is operated earlier than the drawing operation of the intermediate transfer unit 50, whereby the intermediate transfer unit 50 lowers, and thus the intermediate transfer belt 51 is spaced from the photosensitive drums 1Y, 1M, 1C, and 1K. At the same time, the secondary transfer roller 24 lowers to be spaced from the intermediate transfer belt 51. According to this constitution, in the drawing process, the intermediate transfer belt 51 is prevented from dragging the photosensitive drums 1Y, 1M, 1C, and 1K and the secondary transfer roller 24 in the axial direction.

<Steering Mechanism>

The both ends of the rotating bodies 52, 53, and 54 of the intermediate transfer unit 50 are integrally supported by a pair of side plate members 58, and the side plate member 58 on the front side has the steering mechanism 40. The steering mechanism 40 controls the wrinkling of the intermediate transfer belt 51 by inclining the steering roller 53. While the end of the steering roller 53 on the back surface side is fixed, the end on the front surface side can be moved in a direction of an arrow R4. According to this constitution, the inclination of the steering roller 53 can be changed. The steering roller 53 has a function of a drive roller which transmits a driving force to the intermediate transfer belt 51.

As shown in FIG. 2, the steering mechanism 40 contains a steering drive motor and a gear mechanism and is controlled by a control portion 110 in response to an output of an edge sensor 26, which is a detection device for detecting the position of the end of the intermediate transfer belt 51.

A protrusion 26*d* of the edge sensor 26 is biased by a spring so as to rotate toward the intermediate transfer belt 51, and the protrusion 26*d* is abutted against the belt edge of the intermediate transfer belt 51. A flag rotating integrally with the protrusion 26*d* in a direction of an arrow R5 around a rotational axis 26*a* as a center is detected by photo-interrupters 26*b* and 26*c*, and the output corresponding to the position of the belt edge in the longitudinal direction of the driving roller 53 is input to the control portion 110.

The control portion 110 determines the present position of the belt edge, based on the result of the edge position detection to operate a driving motor of the steering mechanism 40, and, thus, to tilt the steering roller 53, whereby meandering of the intermediate transfer belt 51 is reduced.

When the intermediate transfer belt 51 is used for a long period of time, the mechanical characteristics are deteriorated. Since the intermediate transfer belt 51 is a consumable, it is required to be periodically exchanged. When a tension is applied to the intermediate transfer belt 51 for a long period of time and continues rotational driving, the edge of the intermediate transfer belt 51 is permanently deformed to be expanded to the side of the photosensitive drums 1Y, 1M, and 1C (FIG. 1).

When the wrinkling of the belt is controlled by detection of the belt edge performed by the edge sensor 26, if the end of the intermediate transfer belt 51 is rolled back caused by usage for a long period of time, the steering control becomes unstable. This is because the protrusion 26*d* of the edge sensor 26 cannot be normally in contact with the belt edge, and the output deviating from the actual position of the belt edge in the longitudinal direction of the steering roller 53 is input to the control portion 110. Due to this, the steering mechanism 40 is frequently operated to unnecessarily continue to substantially tilt the driving roller 53, and resulting in substantial meandering of the intermediate transfer belt 51 during the rotational driving.

In the image forming apparatus 100, a plurality of toner colors are superposed on the intermediate transfer belt 51 to from a full-color image, and therefore, due to the meandering of the intermediate transfer belt 51, the toner images of the respective colors are transferred while deviating in the width direction of the intermediate transfer belt 51 (rotational axis direction of the intermediate transfer belt), whereby the color deviation occurs in the final image. Also in a secondary transfer portion T2 (FIG. 1), since the image position deviates in the width direction of the conveyed recording material P, improper left and right margins are formed, and in the formation of a double-sided image, a front image and a rear image are deviated from each other.

<Contact/Separation Mechanism>

Figure 4:
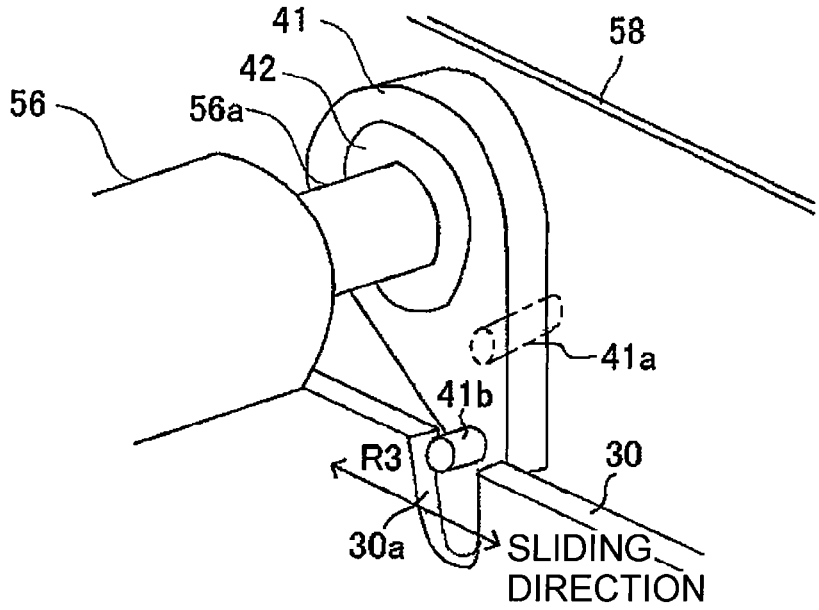
FIG. 4 is an explanatory view of a contact/separation mechanism of a tension roller.
Figure 5:
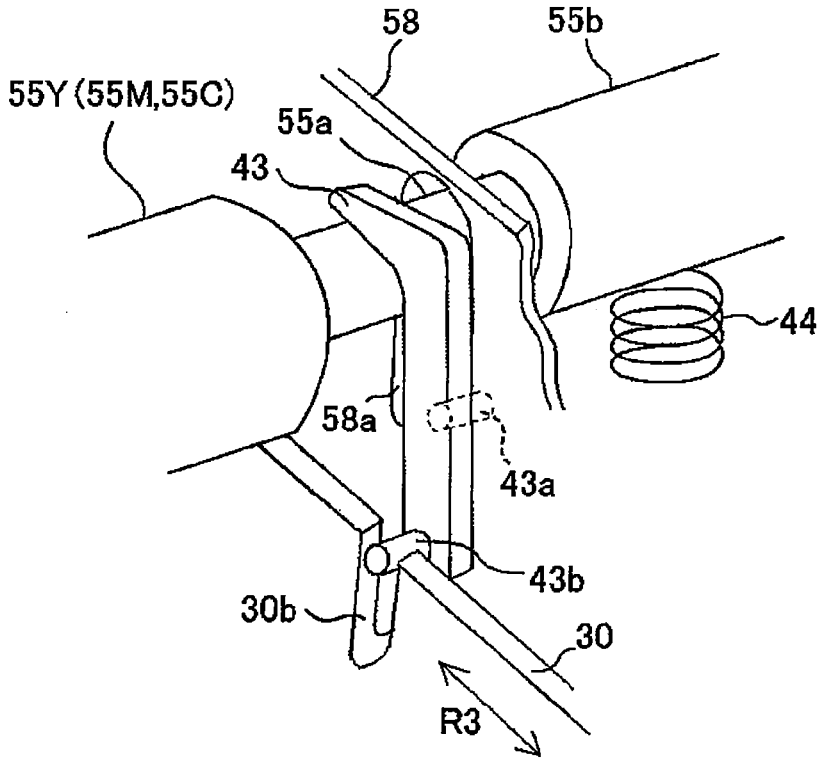
FIG. 5 is an explanatory view of a contact/separation mechanism of a primary transfer roller.

FIG. 3 is an explanatory view of a full-color mode and a black monochrome mode. FIG. 4 is an explanatory view of a contact/separation mechanism of a tension roller. FIG. 5 is an explanatory view of a contact/separation mechanism of a primary transfer roller. The full-color mode is a first image formation mode where a plurality of image bearing members and a belt member are in contact with each other to form an image. The monochrome mode is a second image formation mode where one image bearing member and the belt member are in contact with each other to form an image. The control portion 110 has a function of an execution portion which can execute the full-color mode and the black monochrome mode.

As shown in FIG. 1, the both ends of the rotating bodies 52, 56, 55Y, 55M, and 55C are supported in a liftable and lowerable manner by a pair of side plate members 58 (FIG. 2) and contact/separation mechanisms 30 and 33. The side plate members 58 (FIG. 2) each have the contact/separation mechanisms 30 and 33. The contact/separation mechanisms 30 and 33 are operated in an interlocked state in accordance with the discrimination between the full-color mode and the black monochrome mode.

Figure 3A:
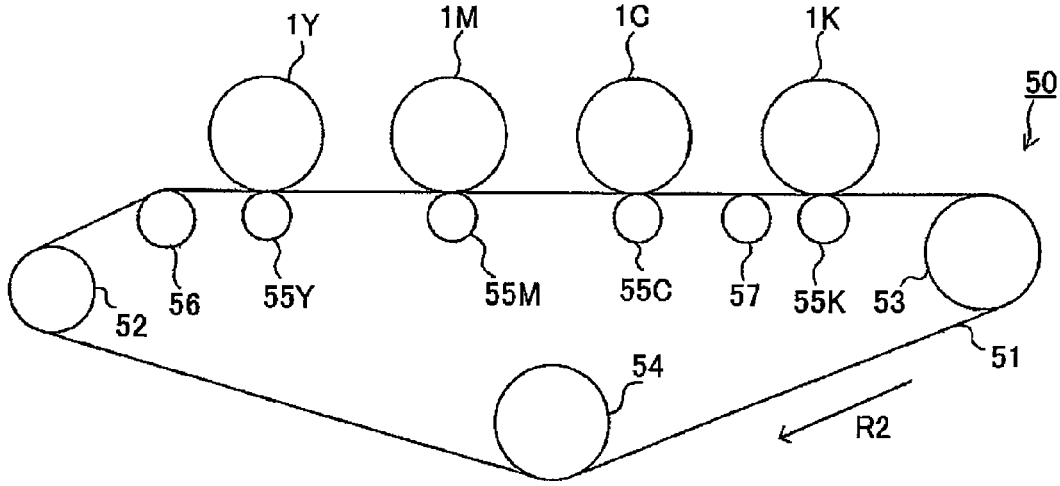
FIGS. 3A and 3B are explanatory views of a full-color mode and a black monochrome mode.

As shown in FIG. 3A, the operation in the full-color mode in the image forming apparatus 100 has been described as above with reference to FIG. 1. A primary transfer surface of the intermediate transfer belt 51, which is in contact with the photosensitive drums 1Y, 1M, 1C and 1K bearing the toner images having the respective color components of yellow, magenta, cyan and black, is stretched by an idler roller 56 and the driving roller 53.

Figure 3B:
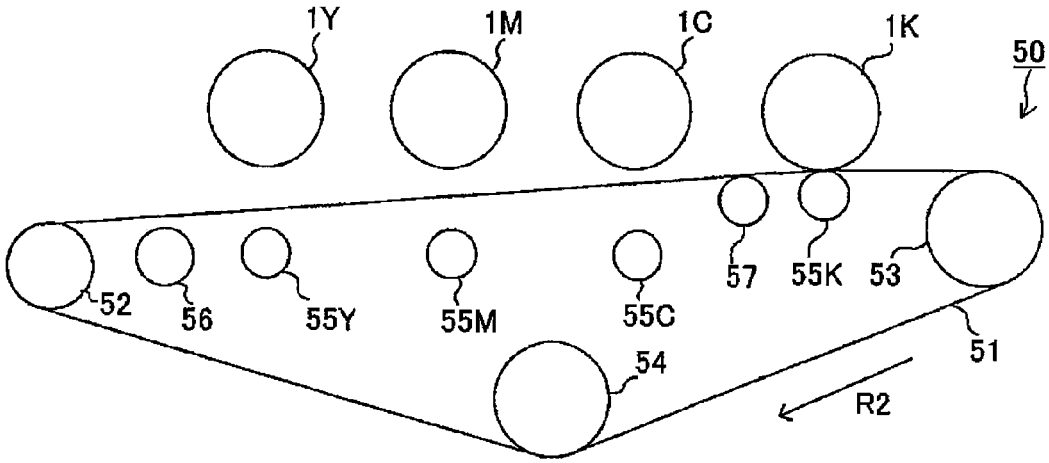

As shown in FIG. 3B, the photosensitive drums 1Y, 1M, and 1C which can be in contact with the intermediate transfer belt 51 of the image forming apparatus 100 are consumables, and thus are required to be periodically exchanged; therefore, they are required to have long lives. Meanwhile, when a monochrome image with a high frequency of use is output, the rotation of the photosensitive drums 1Y, 1M, and 1C having unused color components is stopped, whereby the consumption is also stopped, and the life extension can be realized.

Thus, when a monochrome image is formed, the black monochrome mode is executed, and the intermediate transfer belt 51 is spaced from the unused photosensitive drums 1Y, 1M, and 1C of yellow, magenta, and cyan. The idler roller 56 provided on the upstream side of the photosensitive drum 1Y is spaced from the stretched surface, whereby the intermediate transfer belt 51 is spaced from the photosensitive drums 1Y, 1M, and 1C of yellow, magenta, and cyan. Since the intermediate transfer belt 51 is reliably spaced from the photosensitive drums 1Y, 1M, and 1C, the primary transfer rollers 55Y, 55M, and 55C are simultaneously spaced from the intermediate transfer belt 51. The photosensitive drums 1Y, 1M, and 1C are first image bearing members which can be brought into and out of contact with the belt member, and the photosensitive drum 1K is a second image bearing member.

The photosensitive drums 1Y, 1M, and 1C are not moved, but the intermediate transfer belt 51 is moved in a direction away from the photosensitive drums 1Y, 1M, and 1C. If the photosensitive drums are moved, the peripheral charging members, development members, and cleaning members should be simultaneously moved integrally with the photosensitive drums, and thus the spacing mechanism is complicated. When the intermediate transfer belt 51 is spaced, only the idler roller 56 and the primary transfer rollers 55Y, 55M, and 55C may be moved, and therefore, the spacing mechanism is relatively simple.

The rotation of the unused photosensitive drums 1Y, 1M, and 1C are then stopped, and the deterioration of the photosensitive drums 1Y, 1M, and 1C, such as abrasion, damage by discharge, and adhesion of a discharge product, is avoided, whereby the replacement lives of the photosensitive drums 1Y, 1M, and 1C are extended.

As shown in FIG. 1, an attachment/detachment link member 30 is mounted in the intermediate transfer unit 50 so as to be movable to a position shown by dashed lines, and a pinion gear 32 meshes with a rack gear formed in a portion of the attachment/detachment link member 30. The control portion 110 controls a drive motor 33 to rotate the pinion gear 32 and thereby to move the attachment/detachment link member 30 to the position shown by the dashed line, whereby the idler roller 56 and the primary transfer rollers 55Y, 55M, and 55C are lowered.

As shown in FIG. 4, a bearing 42 of the idler roller 56 is fixed to a bearing holder 41 which can rotate around a shaft 41*a* with respect to the side plate 58. The bearing 42 rotatably holding a shaft 56*a* of the idler roller 56 is held by the bearing holder 41, and the attachment/detachment link member 30 attaches and detaches the idler roller 56. A boss 41*b* of the bearing holder 41 is fitted into a recess 30*a* of the attachment/detachment link member 30, and the position of the boss 41*b* is varied by sliding movement of the attachment/detachment link member 30, whereby the bearing holder 41 is rotated.

The attachment/detachment link member 30 is moved in a direction of an arrow R3, whereby the boss 41*b* engaged in a groove 30*a* is driven in the direction of the arrow R3. According to this constitution, the bearing holder 41 rotates around the shaft 41*a*, and the idler roller 56 which has a rotational shaft 56*a* supported by the bearing 42 is lifted or lowered.

As shown in FIG. 5, outside the side plate 58, the primary transfer rollers 55Y, 55M, and 55C are applied a force by a pressure spring 44, which has one end fixed to the side plate 58, in a direction to be in press-contact with the photosensitive drums 1Y, 1M, and 1C. Each cored bar 55*a* of the primary transfer rollers 55Y, 55M, and 55C can be lifted and lowered along a long hole 58*a* of the side plate 58. The rotational shaft 56*a* is lifted and lowered while engaged with a primary transfer roller attachment/detachment lever 43 turnable around a shaft 43*a*. The primary transfer rollers 55Y, 55M, and 55C are in press-contact with the photosensitive drums 1Y, 1M, and 1C in a state of being released from the engagement with the primary transfer roller attachment/detachment lever 43.

The both ends of the cored bars 55*a* of the primary transfer rollers 55Y, 55M, and 55C are held by a liftably and lowerably supported bearing 55*b* and pressurized by the pressure spring 44 in the direction of the photosensitive drums 1Y, 1M, and 1C.

When the primary transfer rollers 55Y, 55M, and 55C are spaced from the photosensitive drums 1Y, 1M, and 1C, the primary transfer roller attachment/detachment lever 43 turns so as to depress the cored bar 55*a* while contracting the pressure spring 44.

Meanwhile, when the primary transfer rollers 55Y, 55M, and 55C are in contact with the photosensitive drums 1Y, 1M, and 1C, the primary transfer roller attachment/detachment lever 43 turns so as to be spaced from the cored bar 55*a*. According to this constitution, a nip pressure of the pressure spring 44 is formed between the primary transfer rollers 55Y, 55M, and 55C and the photosensitive drums 1Y, 1M, and 1C.

The attachment/detachment link member 30 is moved in the direction of the arrow R3, whereby the boss 43*b* engaged in a groove 30*b* is driven in the direction of the arrow R3. According to this constitution, primary transfer roller attachment/detachment lever 43 turns around the shaft 43*a* to lift the cored bar 55*a*, and in such a state that the primary transfer rollers 55Y, 55M, and 55C are in press-contact with the photosensitive drums 1Y, 1M, and 1C, the engagement of the cored bar 55*a* is released. Alternatively, primary transfer roller attachment/detachment lever 43 turns around the shaft 43*a* to depress the cored bar 55*a*, and, thus, to space the primary transfer rollers 55Y, 55M, and 55C from the photosensitive drums 1Y, 1M, and 1C.

As shown in FIG. 3B, in the black monochrome mode, the intermediate transfer belt 51 is spaced from the primary transfer rollers 55Y, 55M, and 55C. At this time, the idler roller 56 lowers the stretched surface of the intermediate transfer belt 51 to space the intermediate transfer belt 51 from the photosensitive drums 1Y, 1M, and 1C. However, since the lowering of the stretched surface of the intermediate transfer belt 51 is blocked by an idler roller 57, it does not affect the nip between the photosensitive drum 1K and the primary transfer roller 55K. Therefore, even if the intermediate transfer belt 51 is spaced from the photosensitive drums 1Y, 1M, and 1C of yellow, magenta, and cyan, the stretched surface of the intermediate transfer belt 51 from the idler roller 57 to the driving roller 53 is maintained as in the full-color mode. Thus, the black monochrome image formation can be realized free from the influence of the photosensitive drum 1K and the change of and the stretched surface of the intermediate transfer belt 51.

However, in the black monochrome mode, the nip of the intermediate transfer belt 51 by the photosensitive drums 1Y, 1M, and 1C and the primary transfer rollers 55Y, 55M, and 55C is eliminated. Therefore, the intermediate transfer belt 51 is not restricted between the tension roller 52 and the idler roller 57, and thus flapping of the intermediate transfer belt 51 increases.

As shown in FIG. 2, with respect to the intermediate transfer belt 51 with a width of 340 mm, the photosensitive drums 1Y, 1M, 1C, and 1K have a length of 345 mm, and the primary transfer rollers 55Y, 55M, 55C, and 55K have a length of 331 mm. Each length of the photosensitive drums 1Y, 1M, 1C, and 1K is larger than the width of the intermediate transfer belt 51. Therefore, in the full-color mode, the end of the intermediate transfer belt 51 is pressed, by the photosensitive drums 1Y, 1M, and 1C, in a direction that the warpage of the end is reduced. Therefore, the amount of warpage of the end of the intermediate transfer belt 51 in the full-color mode is smaller than the amount of warpage of the end of the intermediate transfer belt 51 in the black monochrome mode.

However, the warped portion of the end of the intermediate transfer belt 51 is abutted against the protrusion 26*d*, and then when the wrinkling of the belt member is controlled, the warpage amount of the end is not stable in the peripheral direction of the intermediate transfer belt 51, and therefore, the control of the wrinkling of the belt member becomes unstable, whereby color deviation occurs.

Thus, in the following examples, in the full-color mode, a pressing member presses the end of the intermediate transfer belt 51 rushing into the photosensitive drums 1Y, 1M, and 1C, and the intermediate transfer belt 51 passes the photosensitive drums 1Y, 1M, and 1C in such a state that the warpage amount is further reduced.

Meanwhile, in the black monochrome mode, even if the warped portion of the end of the intermediate transfer belt 51 is abutted against the protrusion 26*d*, and then the wrinkling of the belt member is controlled, color deviation does not occur. However, the position of the intermediate transfer belt in a case where the wrinkling of the belt member is controlled in the warped portion of the end is substantially different from the position of the intermediate transfer belt in a case where the wrinkling of the belt member is controlled when the warpage of the end is reduced.

Therefore, in such a state that the end of the intermediate transfer belt 51 warps in the black monochrome mode, when the mode is shifted from the black monochrome mode to the full-color mode, the adjustment amount of the belt position is increased, whereby the color matching accuracy may be lowered.

Therefore, in the black monochrome mode, it is effective that the end of the intermediate transfer belt 51 free from the restriction between the tension roller 52 and the idler roller 57 is pressed by the same pressing member to reduce the flapping of the intermediate transfer belt 51.

Example 1

Figure 6:
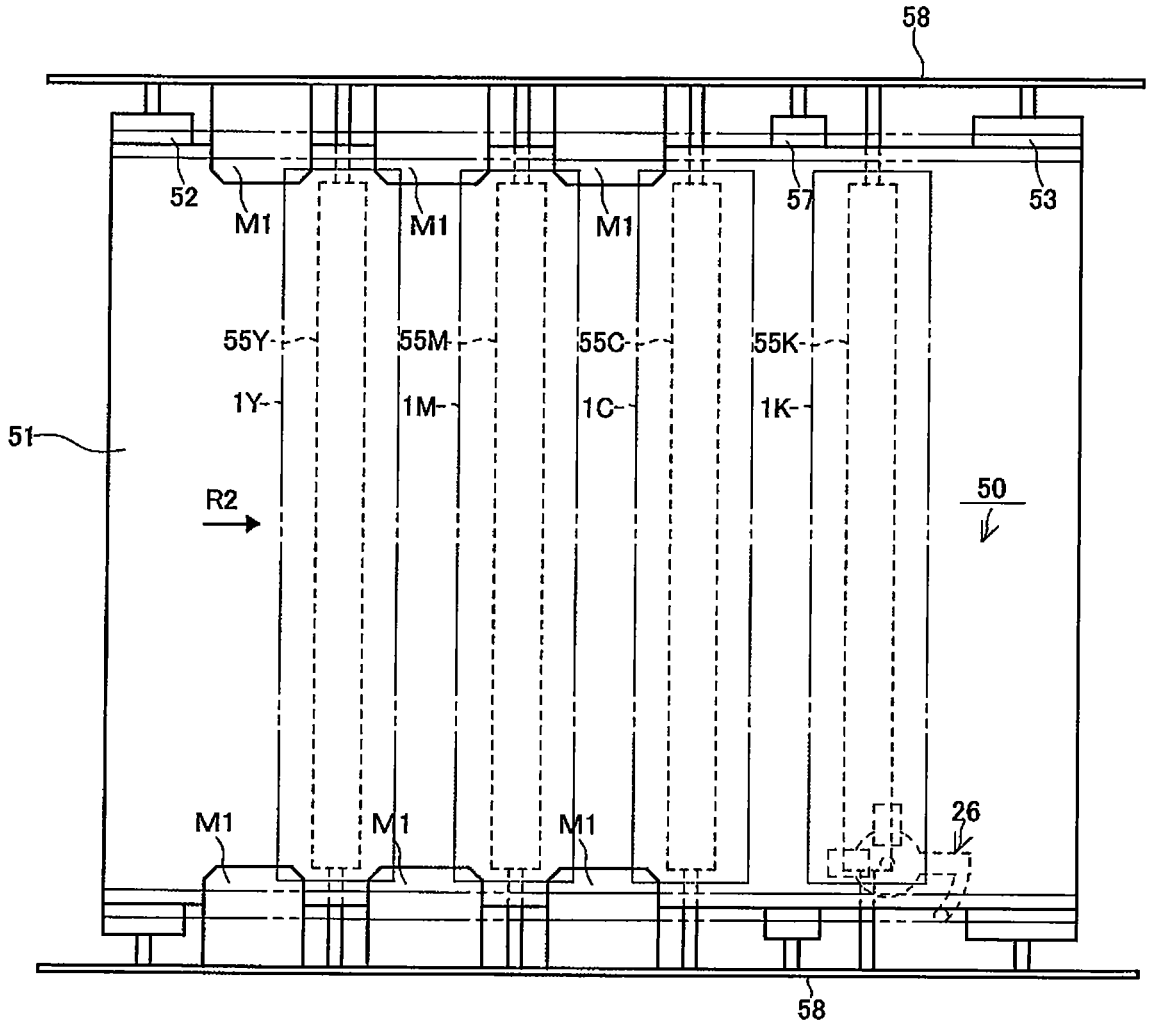
FIG. 6 is an explanatory view of disposition of a pressing member in an example 1.

FIG. 6 is an explanatory view of disposition of a pressing member in an example 1. FIG. 7 is an explanatory view of regulation of an end of a belt member performed by the pressing member. The pressing member is disposed upstream of the edge sensor 26 in the rotational direction of the belt member.

As shown in FIG. 6, in the example 1, a pressing member M1 is constituted of an elastic member having one end fixed to the side plate member 58 and disposed in a cantilever form, and the front end slides and rubs against one surface on the photosensitive drum side. The pressing member M1 is provided between the photosensitive drums, and the pressing members M1 are disposed on the both end sides of the intermediate transfer belt 51. The pressing member M1 is at least disposed between the photosensitive drum 1Y on the uppermost stream side and the edge sensor 26.

In the above example, the pressing member and the edge sensor 26 are disposed on the belt surface facing the plurality of photosensitive drums, and the steering roller 53 is disposed on the lowermost stream side of the belt surface in the rotational direction of the intermediate transfer belt 51. The belt surface faces the plurality of photosensitive drums in the full-color mode.

In the pressing member M1, the front end slides and rubs against the belt member to the inside of a press-contact range where the belt member is in press-contact with the photosensitive drums in a moving range of the belt member by the steering mechanism.

The pressing members M1 are arranged with an elastic deformation so as to continuously press the end of the belt member at an interval of the photosensitive drums and formed of a resin sheet material having an elastic coefficient lower than the belt member and a thickness larger than the belt member.

An end mylar M1 regulating the end of the intermediate transfer belt 51 is mounted to the side plate 58 of the intermediate transfer unit 50 while being elastically deformed and applies a force to the image bearing surface of the intermediate transfer belt 51 toward the primary transfer rollers 55Y, 55M, and 55C. The end mylar M1 is provided to press one surface on the photosensitive drum side (rotating body side) of the end of the intermediate transfer belt 51, whereby in the black monochrome mode, the end of the intermediate transfer belt 51 is prevented from being warped and deformed to the photosensitive drum side (rotating body side).

In the example 1, the intermediate transfer belt 51 is formed of polyimide resin as a base material and has an elastic coefficient of 3 to 5 GPa and a thickness of 100 μm. Meanwhile, the end mylar M1 of a PET film has an elastic coefficient of 1 GPa and a thickness of 188 μm. The end mylar M1 is applied to the side plate 58 with a double-sided tape.

In order to regulate the end of the intermediate transfer belt 51, the end mylar M1 preferably has an elastic coefficient of not less than 0.1 GPa and not more than 3 GPa. The end mylar M1 is formed of not only the PET film but also preferably formed of a resin material, such as polycarbonate, polyacetal, and nylon, having smaller elastic coefficient and larger thickness than the intermediate transfer belt 51.

The end mylar M1 having an elastic coefficient of less than 1.0 GPa is too soft for polyimide and is unsuitable for the end regulation. Meanwhile, in a material having an elastic coefficient of more than 3 GPa, since the elastic coefficient is comparable to the elastic coefficient of polyimide, the belt end may be depressed, whereby the end may be folded. The end mylar M1 is required to have a pressing force which can prevent the warpage of the hard intermediate transfer belt 51 without giving a damage to the intermediate transfer belt 51 upon sliding and rubbing of the intermediate transfer belt 51.

The end mylar M1 has a front end width of 70 mm and a root width of 80 mm. The end mylar M1 covers almost the entire interval of 90 mm of the photosensitive drums 1Y, 1M, and 1C having a diameter of 30 mm and is continuously in contact with the intermediate transfer belt 51.

Figure 7A:
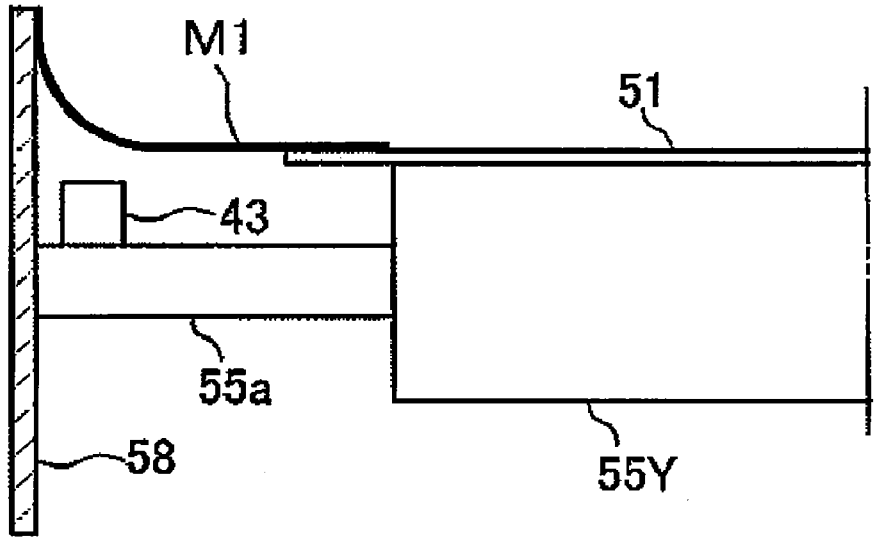
FIGS. 7A and 7B are explanatory views of the end regulation of a belt member performed by the pressing member.

As shown in FIG. 7A with reference to FIG. 3A, a bending habit is applied to the end mylar M1 by a heating iron to form the end mylar M1 into an L shape. The end mylar M1 is applied onto the side plate 58 at a position higher by about 3 mm than the image bearing surface of the intermediate transfer belt 51 in the full-color mode. In the example 1, even in such a state that the intermediate transfer belt 51 is in contact with the photosensitive drums 1Y, 1M, and 1C, the end mylar M1 is in contact with the intermediate transfer belt 51 to regulate the end of the intermediate transfer belt 51.

As described above, the end of the intermediate transfer belt 51 is warped to the image bearing surface side by subjected to a locally large stress when the intermediate transfer belt 51 is steering-controlled while receiving a rotational driving in a state of being stretched. The end of the intermediate transfer belt 51 is partially extended to relieve the stress, whereby the peripheral length of the extended end escapes outside the rotating body to cause the warpage of the end of the intermediate transfer belt 51.

In the full-color mode, the photosensitive drums 1Y, 1M, 1C, and 1K apply a pressure to the intermediate transfer belt 51 to prevent the intermediate transfer belt 51 from flapping to the side of the photosensitive drums 1Y, 1M, 1C, and 1K. Therefore, a stress amplitude, which occurs in the end in contact with the tension roller 52 and the driving roller 53 upon flapping of the intermediate transfer belt 51, is small.

Figure 7B:
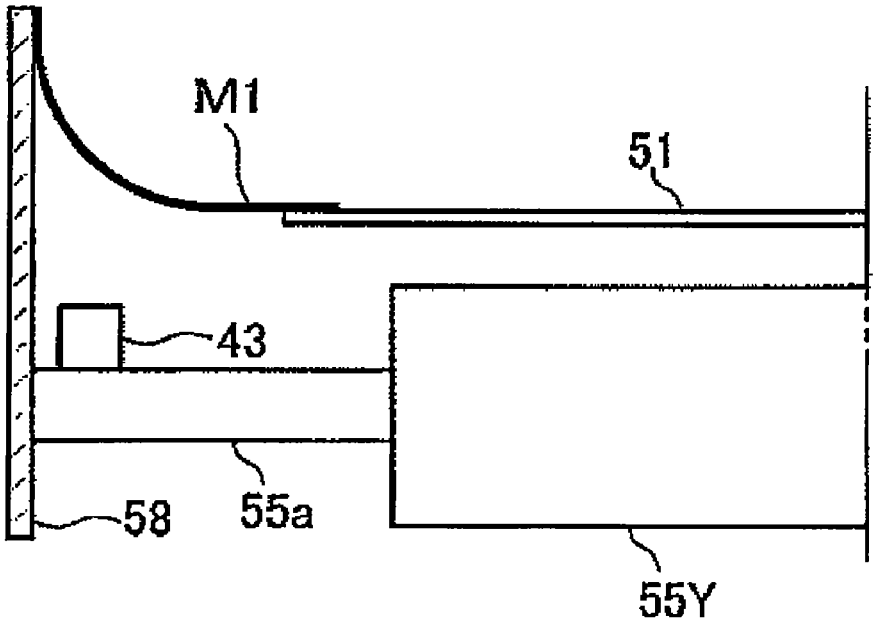

As shown in FIG. 7B with reference to FIG. 3B, in the black monochrome mode, the intermediate transfer belt 51 is spaced from the photosensitive drums 1Y, 1M, and 1C by up to 2 mm from the state of being in contact with the photosensitive drums. The end mylar M1 is applied onto the side plate 58 at a position of "3 mm+2 mm=about 5 mm" from the image bearing surface of the intermediate transfer belt 51 spaced from the photosensitive drums 1Y, 1M, and 1C.

In the black monochrome mode, since the intermediate transfer belt 51 and the photosensitive drums 1Y, 1M, and 1C are spaced from each other, the intermediate transfer belt 51 substantially flaps between the tension roller 52 and the idler roller 57. Therefore, in the black monochrome mode, the stress amplitude, which occurs in the end in contact with the tension roller 52 and the driving roller 53, increases accompanying the flapping of the intermediate transfer belt 51 traveling at high speed. Since the image bearing surface does not have a member for applying a pressure to the intermediate transfer belt 51 to limit the lifting of the end, the intermediate transfer belt 51 is freely deformed to accelerate the warpage deformation and the waving deformation of the end of the intermediate transfer belt 51.

The end mylar M1 suppresses the flapping of the intermediate transfer belt 51 instead of the photosensitive drums 1Y, 1M, and 1C and reduces the tension amplitude accompanying such waving oscillation occurring in the end of the intermediate transfer belt 51 in contact with the tension roller 52 and the idler roller 57. According to this constitution, the steering control performed by operating the steering mechanism 40 based on the output of the edge sensor 26 becomes stable.

In the example 1, a biasing force of the end mylar M1 applied onto the side plate 58 is applied to the intermediate transfer belt 51, and the biasing force in the full-color mode is larger than that in the black monochrome mode. This is because in the full-color mode of applying a pressure to the end of the intermediate transfer belt 51 at a distance of about 3 mm from the application position of the end mylar M1, the amount of deflection of the end mylar M1 is larger than that in the black monochrome mode of applying a pressure to the end of the intermediate transfer belt 51 at a distance of about 5 mm from the application position.

As a reason for that, in the full-color mode, the color deviation is required to be reduced, and therefore, the warpage amount is required to be further reduced. Meanwhile, in the black monochrome mode, since the color deviation does not occur, the warpage amount is allowed to be slightly large.

Comparative Example

FIG. 8 is an explanatory view of the end regulation performed by a pressing member in a comparative example.

Figure 8A:
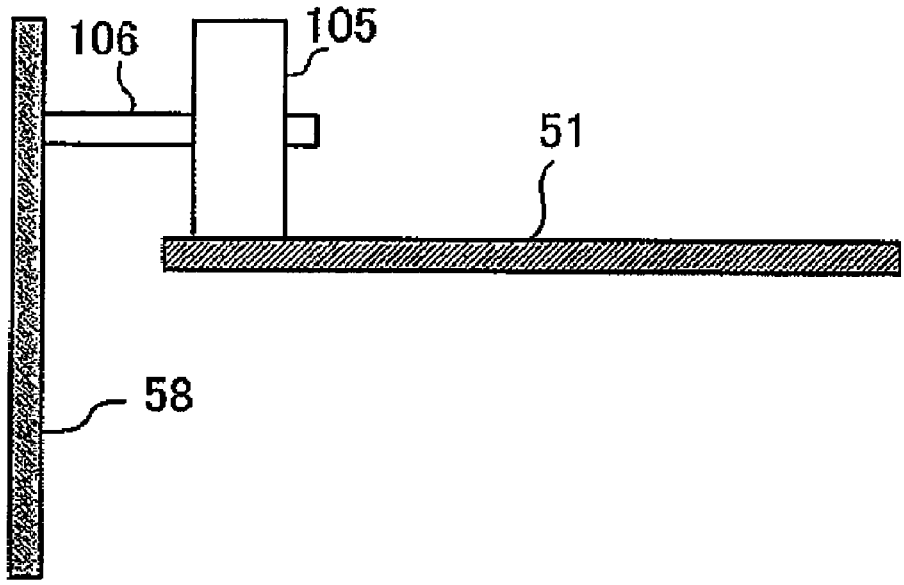
FIGS. 8A and 8B are explanatory views of the end regulation performed by a pressing member in a comparative example.

As shown in FIG. 8A, in the comparative example, a shaft 106 of a guide roller 105 is fixed to the side plate 58 so as to match the height of the intermediate transfer belt 51 in the full-color mode. The end on the image baring surface side of the intermediate transfer belt 51 is regulated by the guide roller 105 so that the warpage of the end is prevented from occurring. The guide roller 105 is rotatably borne by the shaft 106 fixed to the side plate 58 and rotates in accordance with the rotation of the intermediate transfer belt 51.

Figure 8B:
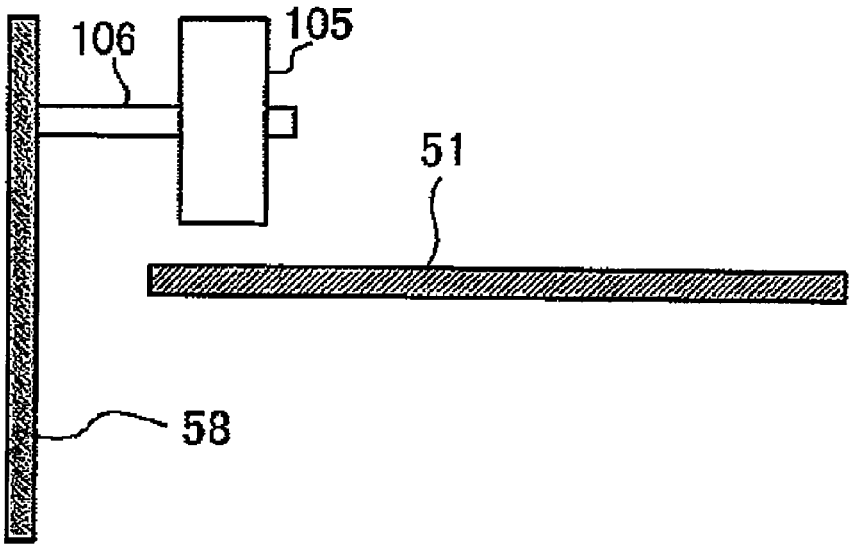

As shown in FIG. 8B, in the comparative example, when the intermediate transfer belt 51 is lowered for the black monochrome mode, the guide roller 105 cannot press the end of the intermediate transfer belt 51. The guide roller 105 cannot be in contact with the intermediate transfer belt 51 spaced from the photosensitive drums 1Y, 1M, and 1C, and the end of the intermediate transfer belt 51 cannot be regulated.

Thus, a long service life of the intermediate transfer belt 51 in the black monochrome mode cannot be secured unlike the example 1. When the intermediate transfer belt 51 is used for a long period of time in a state of being spaced, the intermediate transfer belt 51 receives a rotational driving in such a state that the regulation of the end of the intermediate transfer belt 51 is unsatisfactory, and therefore, the end of the intermediate transfer belt 51 is warped. Further, when the warpage of the end is further deteriorated, the edge sensor 26 cannot be in contact with the end, an alarm stop control is performed to interrupt the image formation.

Example 2

Figure 9:
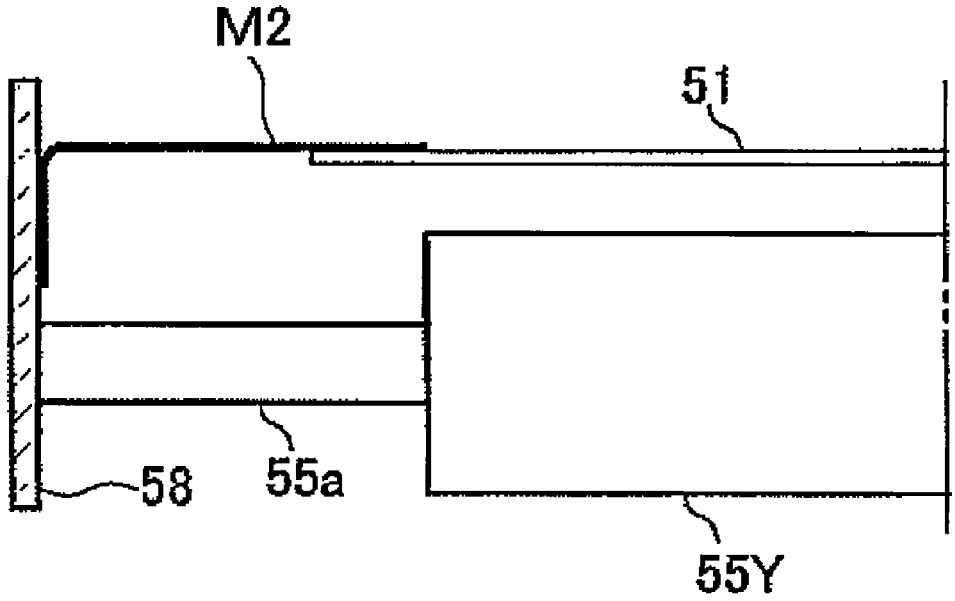
FIG. 9 is an explanatory view of a mounting structure of a pressing member in an example 2.

FIG. 9 is an explanatory view of a mounting structure of a pressing member in the example 2.

The example 2 is similar to the example 1 except that a mounting structure of an end mylar M2 mounted to the side plate 58 is different from the end mylar M1, and the control in the example 2 is performed similarly to the example 1. The disposition and function of the end mylar 2 as the pressing member are the same as the end mylar M1 in the example 1.

As shown in FIG. 9, a bending habit is applied to the end mylar M2 by a heating iron to form the end mylar 2 into an L shape curved downward. As described above, in the full-color mode, the belt surface is lifted by 2 mm compared with the black monochrome mode. Therefore, the biasing force of the end mylar M2 accompanying the elastic deformation in the full-color mode can be rendered larger than the biasing force accompanying the elastic deformation in the black monochrome mode. Thus, also in the full-color mode, the warpage of the end of the belt member can be reduced.

Example 3

Figure 10:
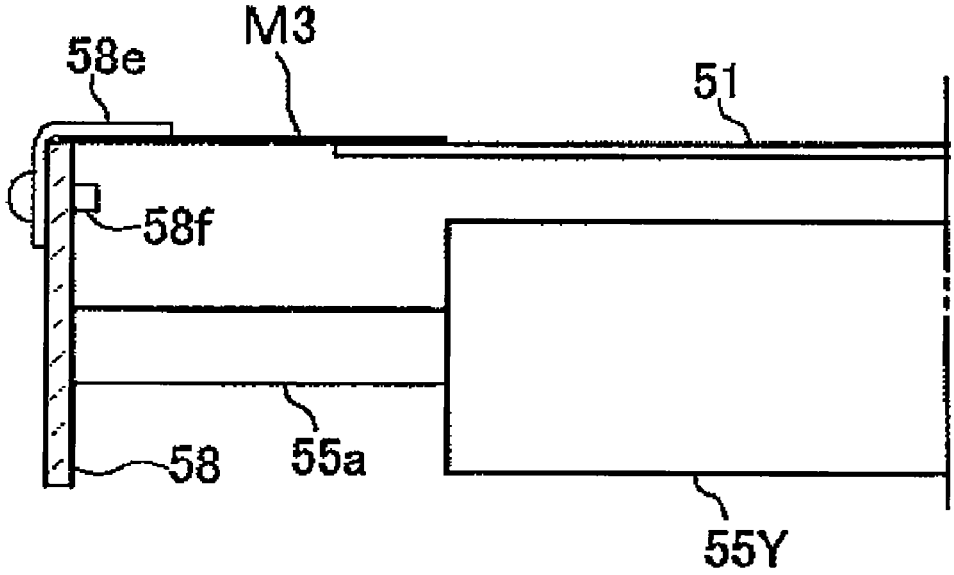
FIG. 10 is an explanatory view of a mounting structure of a pressing member in an example 3.

FIG. 10 is an explanatory view of a mounting structure of a pressing member in an example 3.

The example 3 is similar to the example 1 except that a mounting structure of an end mylar M3 mounted to the side plate 58 is different from the end mylar M1, and the control in the example 3 is performed similarly to the example 1. The disposition and function of the end mylar 3 as the pressing member are the same as the end mylar M1 in the example 1.

As shown in FIG. 10, the end mylar M3 is applied onto a steel plate angle material 58*e* with a thickness of 0.2 mm by using a double-sided tape. The angle material 58*e* is fixed to the side plate 58 by using a screw 58*f* at a position lower by about 2.5 mm than the image bearing surface of the intermediate transfer belt 51 in the full-color mode. In the full-color mode, the belt surface is lifted by 2 mm compared with the black monochrome mode. Therefore, the biasing force of the end mylar M3 accompanying the elastic deformation in the full-color mode can be rendered larger than the biasing force accompanying the elastic deformation in the black monochrome mode. Thus, also in the full-color mode, the warpage of the end of the belt member can be reduced. Namely, the biasing force in the full color mode is increased, and the biasing force in the black monochrome mode is reduced.

Example 4

Figure 11:
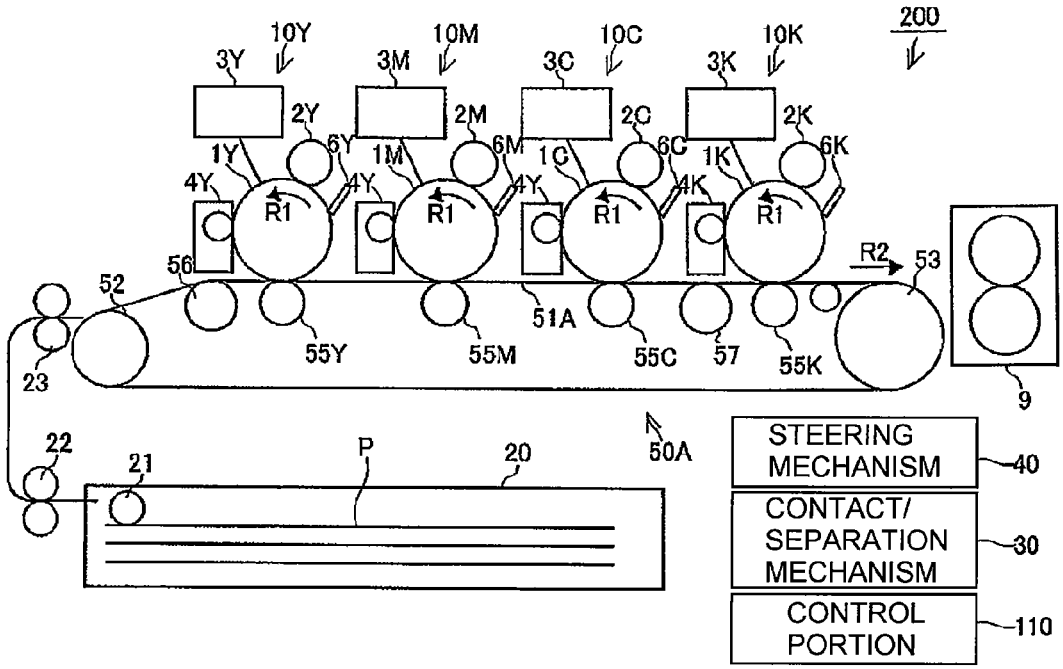
FIG. 11 is an explanatory view of a configuration of an image forming apparatus in an example 4.

FIG. 11 is an explanatory view of a configuration of an image forming apparatus in the example 4.

In the examples 1 to 4, the examples of the image forming apparatus of a tandem intermediate transfer type have been described; however, the present invention is not limited to these examples, and the present invention can be applied to, for example, a tandem direct transfer type image forming apparatus.

As shown in FIG. 11, in an image forming apparatus 200, the image forming portions 10Y, 10M, 10C, and 10K directly transfer the toner images of the respective colors onto the recording material P borne on a recording material conveying belt 51A, and the toner images are superposed. The constitution and function of the image forming portions 10Y, 10M, 10C, and 10K are the same as the example 1.

The image forming apparatus 200 of the example 4 has a steering mechanism 40 similar to the steering mechanism of the image forming apparatus 100 shown in FIG. 1 and performs steering-control of the recording material conveying belt 51A to position the recording material conveying belt 51A in the axial direction of the driving roller 53. The image forming apparatus 200 further has a contact/separation mechanism 30 similar to the contact/separation mechanism of the image forming apparatus 100 shown in FIG. 1, and in the black monochrome mode, the recording material conveying belt 51A is spaced from the photosensitive drums 1Y, 1M, and 1C.

In the above constitution, a similar effect can be obtained by using the constitution of the present invention.

In the full-color mode, the belt member may be spaced from the photosensitive drums of yellow, magenta, and cyan. Therefore, the pressing member pressing the belt member in the full-color mode may be spaced from the belt member in the black monochrome mode. Even in such a case, even if at least one pressing member pressing the belt member in the full-color mode presses the belt member in the black monochrome mode, the warpage amount of the end of the belt member in the black monochrome mode can be reduced, and a similar effect can be obtained. In that case, also when the pressing force of the pressing member pressing the belt member in the black monochrome mode is rendered smaller than the pressing force of pressing belt member in the full-color mode, the effects described in the above examples can be obtained.

As described above, according to the present invention, when the position of the end of the belt member is detected and the steering control is performed, even if the end of the belt member warps, the variation of the wrinkling adjustment in the shift from the BK monochrome mode to the color mode can be reduced.

Although the examples of the present invention have been described, this invention is not limited to the above examples, but can be variously modified within the scope of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-270346, filed Oct. 20, 2008, which is hereby incorporated by reference herein in its entirety.

What is claimed is:

1. An image forming apparatus comprising:

a first image bearing member which bears a toner image;

a second image bearing member which bears a toner image;

a rotatable belt member;

a first transfer member which is arranged in an inner side of the belt member, presses the belt member so that the belt member makes contact with the first image bearing member, and transfers the toner image on the first image bearing member onto the belt member;

a second transfer member which is arranged in an inner side of the belt member, presses the belt member so that the belt member makes contact with the second image bearing member, and transfers the toner image on the second image bearing member onto the belt member;

a detection member which contacts an edge of an end of the belt member in a width direction thereof and detects a position of the belt member in the width direction thereof in a position downstream and adjacent to a contact position of the belt member with the second image bearing member in a rotation direction of the belt member;

an adjustment mechanism which adjusts the position of the belt member in the width direction thereof based on an output of the detection member;

an execution portion which executes a first image formation mode, where the belt member is in contact with the first image bearing member and the second image bearing member and an image is formed on the belt member by being transferred from the first and second image bearing members, and a second image formation mode, where the first transfer member is spaced from the belt member so that the belt member is spaced from the first image bearing member, and, at the same time, the belt member is in contact with the second image bearing member and so that an image is formed on the belt member by being transferred from the second image bearing member; and a pressing member which presses, from a side of the first image bearing member, an end of the belt member which is in a region moved from a position in the first image formation mode so that the belt member is spaced from the first image bearing member, at least in the second image formation mode.

2. The image forming apparatus as claimed in claim 1, further comprising:

a plurality of support rotating bodies supporting the belt member; and a pair of side plate members respectively integrally supporting both ends of the plurality of support rotating bodies, wherein the pressing member is an elastic member, which is disposed in a cantilever form with one end thereof fixed to one of the side plate members and the other end thereof arranged as a free end, and is mounted while being elastically deformed so as to press the end of the belt member in both cases where the belt member is in a position spaced from the first image bearing member and in a position making contact with the first image bearing member.

3. The image forming apparatus as claimed in claim 1, wherein a front end of a free end of the pressing member presses the belt member in a range leading to an inner side within a range of contact of the belt member in the width direction thereof with the first image bearing member.

4. The image forming apparatus as claimed in claim 1, wherein the pressing member is disposed on a position adjacent to upstream and downstream sides of a position in which the belt member makes contact with the first image bearing member in the rotation direction of the belt member.

5. The image forming apparatus as claimed in claim 1, wherein the pressing member is formed of a resin sheet material having an elastic coefficient lower than the belt member and a thickness larger than the belt member.

6. The image forming apparatus as claimed in claim 1, wherein a force of the pressing member for pressing the end of the belt member in the second image formation mode is smaller than a force of the pressing member for pressing the end of the belt member in the first image formation mode.

7. An image forming apparatus comprising:

a first image bearing member which bears a toner image;

a second image bearing member which bears a toner image;

a rotatable belt member which bears a recording material;

a first transfer member which is arranged in an inner side of the belt member, presses the belt member which bears the recording material so that the recording material makes contact with the first image bearing member, and transfers the toner image on the first image bearing member onto the recording material;

a second transfer member which is arranged in an inner side of the belt member, presses the belt member which bears the recording material so that the recording material makes contact with the second image bearing member, and transfers the toner image on the second image bearing member onto the recording material;

a detection member which contacts an edge of an end of the belt member in a width direction thereof and detects a position of the belt member in the width direction thereof in a position downstream and adjacent to a contact position of the recording material borne on the belt member with the second image bearing member in a rotation direction of the belt member;

an adjustment mechanism which adjusts the position of the belt member in the width direction thereof based on an output of the detection member;

an execution portion which executes a first image formation mode, where the recording material borne on the belt member is in contact with the first image bearing member and the second image bearing member and an image is formed on the recording material borne on the belt member by being transferred from the first and second image bearing members, and a second image formation mode, where the first transfer member is spaced from the belt member bearing the recording material so that the recording material borne on the belt member is spaced from the first image bearing member, and the recording material borne on the belt member is in contact with the second image bearing member so that an image is formed on the recording material borne on the belt member by being transferred from the second image bearing member; and a pressing member which presses, from a side of the first image bearing member, an end of the belt member which is in a region moved from a position in the first image formation mode so that the recording material is spaced from the first image bearing member, at least in the second image formation mode.

8. The image forming apparatus as claimed in claim 7, further comprising:

a plurality of support rotating bodies supporting the belt member; and a pair of side plate members respectively integrally supporting both ends of the plurality of support rotating bodies, wherein the pressing member is an elastic member, which is disposed in a cantilever form with one end thereof fixed to one of the side plate members and the other end thereof arranged as a free end, and is mounted while being elastically deformed so as to press the end of the belt member in both cases where the recording material borne on the belt member is in a position spaced from the first image bearing member and in a position making contact with the first image bearing member.

9. The image forming apparatus as claimed in claim 7, wherein a front end of a free end of the pressing member presses the belt member in a range leading to an inner side within a range of contact of the belt member in the width direction thereof with the first image bearing member.

10. The image forming apparatus as claimed in claim 7, wherein the pressing member is disposed on a position adjacent to upstream and downstream sides of a position in which the belt member makes contact with the first image bearing member in the rotation direction of the belt member.

11. The image forming apparatus as claimed in claim 7, wherein the pressing member is formed of a resin sheet material having an elastic coefficient lower than the belt member and a thickness larger than the belt member.

12. The image forming apparatus as claimed in claim 7, wherein a force of the pressing member for pressing the end of the belt member in the second image formation mode is smaller than a force of the pressing member for pressing the end of the belt member in the first image formation mode.

* * * * *